US005553425A

United States Patent [19]

Sampson et al.

[11] Patent Number: 5,553,425

[45] Date of Patent: Sep. 10, 1996

[54] FLASHING AND COUNTERFLASHING

[75] Inventors: Robert C. Sampson, Alfred; Sean T. Flanigan, Falmouth, both of Me.

[73] Assignee: Wasco Products, Inc., Sanford, Me.

[21] Appl. No.: 341,473

[22] Filed: Nov. 17, 1994

[51] Int. Cl.[6] ..... E04D 13/14; E04D 13/03

[52] U.S. Cl. ..... 52/58; 52/200; 52/198; 52/745.15; 52/741.4

[58] Field of Search ..... 52/60, 59, 58, 52/198–200, 219, 741.4, 745.15, 579, 520

[56] References Cited

U.S. PATENT DOCUMENTS

| | | | |
|---|---|---|---|
| 2,168,204 | 8/1939 | Hanson | 52/60 |
| 2,755,484 | 7/1956 | Hotz | 52/59 X |
| 2,822,762 | 2/1958 | Berg | 52/60 |
| 2,851,973 | 9/1958 | Stark . | |
| 2,974,448 | 3/1961 | Weis | 52/60 |
| 2,984,049 | 5/1961 | Reddy | 52/60 |
| 3,237,352 | 3/1966 | Edwards | 52/60 |
| 3,241,271 | 3/1966 | Berg | 52/58 |
| 3,359,692 | 12/1967 | Dzwonkas | 52/60 |
| 3,461,625 | 8/1969 | Sandow . | |
| 4,004,381 | 1/1977 | Pichler et al. | 52/60 |
| 4,190,989 | 3/1980 | Sakharoff | 52/741.4 X |
| 4,388,784 | 6/1983 | Jentoft et al. . | |
| 4,439,962 | 4/1984 | Jentoft et al. . | |
| 4,449,340 | 5/1984 | Jentoft et al. . | |
| 4,455,799 | 6/1984 | Jentoft et al. . | |
| 4,527,368 | 7/1985 | Jentoft et al. . | |
| 4,589,238 | 5/1986 | Sampson et al. . | |
| 4,603,517 | 8/1986 | Lyons . | |
| 4,700,512 | 10/1987 | Laska . | |
| 4,702,049 | 10/1987 | Sampson et al. . | |
| 4,896,468 | 1/1990 | Sampson et al. . | |
| 4,928,445 | 5/1990 | Sampson et al. . | |
| 4,941,300 | 1/1990 | Lyons . | |
| 4,987,705 | 1/1991 | Sampson et al. . | |
| 5,044,133 | 9/1991 | Sampson et al. . | |
| 5,046,292 | 9/1991 | Sampson et al. . | |
| 5,077,943 | 1/1992 | McGady . | |
| 5,148,643 | 9/1992 | Sampson et al. . | |
| 5,207,036 | 5/1993 | Sampson et al. . | |
| 5,357,720 | 10/1994 | O'Keefe et al. | 52/58 |

FOREIGN PATENT DOCUMENTS

| | | | |
|---|---|---|---|
| 2611182 | 9/1977 | Germany | 52/58 |

OTHER PUBLICATIONS 4 p. from Keyston Flashing Co. 2310 N. 28th St. Phila. PA. Brochure Printed Dec. 1953.

*Primary Examiner*—Robert J. Canfield
*Attorney, Agent, or Firm*—Wolf, Greenfield & Sacks, P.C.

[57] ABSTRACT

A sealing system for sealing a cover about a roof opening. The system includes a perimeter sill having as a retaining clip and tab, a counterflashing, and a retaining rod placed between the counterflashing the retaining clip for securing the counterflashing piece in place. The counterflashing piece is inserted between the retaining clip and the retaining tab. The retaining clip provides the pressure against the retaining rod to prevent the counterflashing piece from slipping. The counterflashing piece has its lower edge shaped to in contact with the building when the counterflashing piece is inserted between the retaining tab and retaining clip.

41 Claims, 6 Drawing Sheets

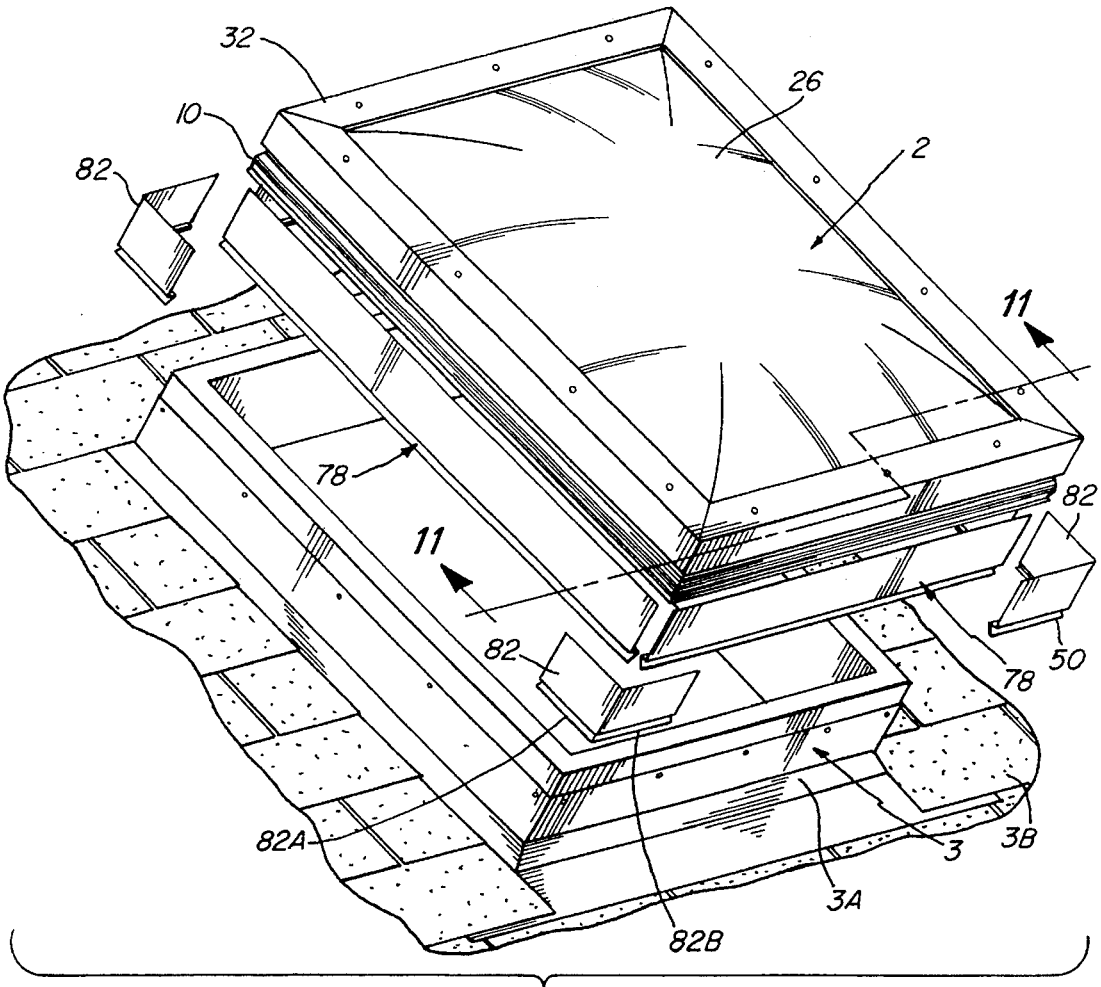
Fig. 10
Fig. 11
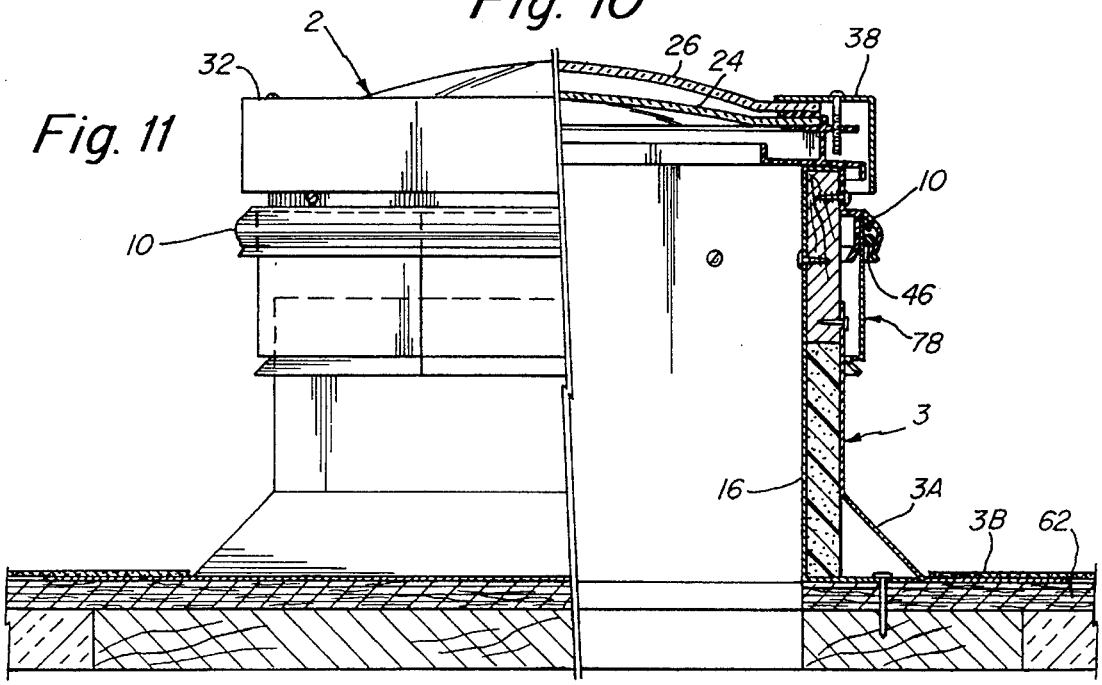

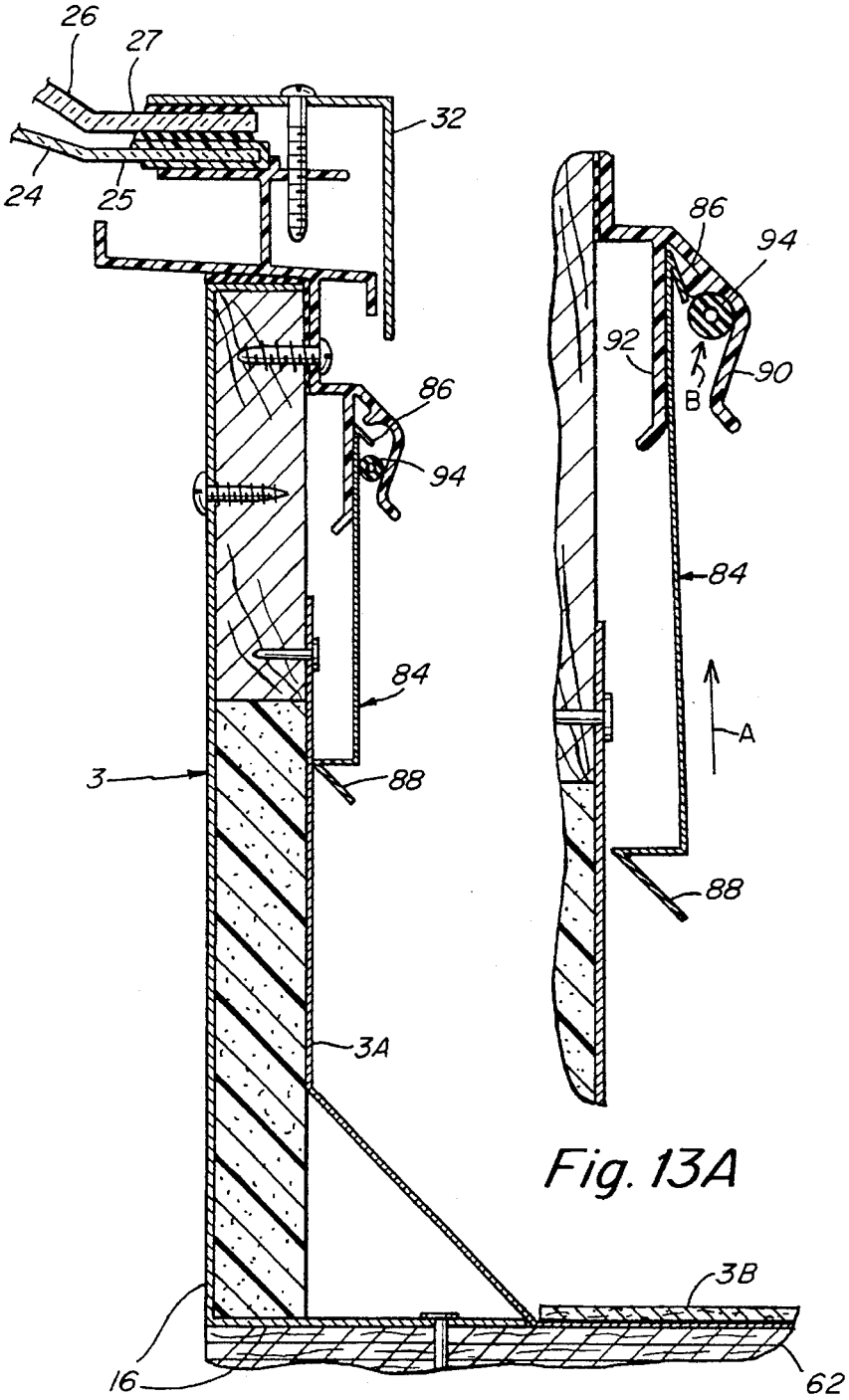
Fig. 12
Fig. 13A
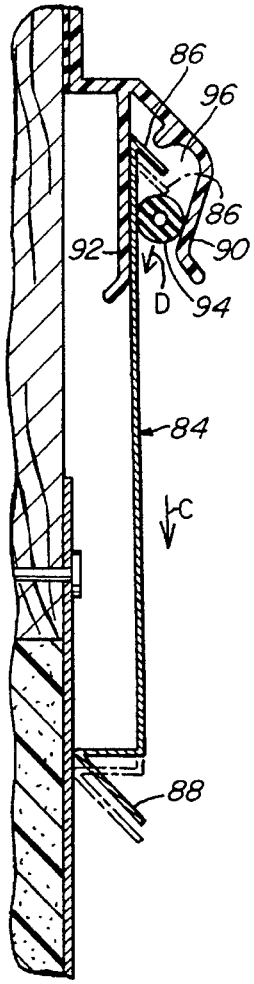
Fig. 13B

FLASHING AND COUNTERFLASHING

BACKGROUND OF THE INVENTION

1. Field of the Invention

The present invention relates in general to skylights and other roof openings and, more particularly, to an improved technique for sealing a skylight or other cover about the opening in a roof.

2. Discussion of Related Art

Roofs are constructed with openings therethrough for a variety of reasons. For example, a skylight cover may be used to cover a roof opening to provide sunlight and possibly ventilation. Other roof covers include fire escape covers, roof maintenance access covers, and heating or ventilated exhaust or intake covers. Such covers may be transparent or opaque and may or may not be capable of opening to allow air to flow into the building or to provide access to the roof.

These roof openings are often defined by a curb. A principle objective of such roof designs is to ensure proper weather sealing of the curb. To this end, roofing membranes have been used to seal the curb, and flashings have been used to direct water away from the curb. For example, U.S. Pat. No, 4,941,300, dated Jul. 17, 1990, illustrates a sealing system using a roofing membrane about a curb.

An object of the present invention is to provide an improved sealing apparatus and method, particularly adapted for sealing skylights or other covers to a curb.

SUMMARY OF THE INVENTION

To accomplish the foregoing and other objects, features and advantages of the invention, there is provided an apparatus for sealing a cover about an opening of a building and a method for using such an apparatus. The apparatus is attachable to the cover and includes a perimeter sill, providing a downwardly facing channel. A counterflashing piece is inserted into the channel and securely retained there by a retaining mechanism, such as a rod, in conjunction with the shape of the channel. The counterflashing has a section such as a hooked end, for contacting a curb of the building to provide a sealing point. The upper, inserted edge of the counterflashing may be flat, or it may be hooked to assist in its retention in the channel.

Several counterflashings may be used in overlapping relation to surround the cover. Each counterflashing may have a straight section for sealing an edge of the cover and include a bend or angled section to wrap around a corner of the curb and overlap an adjacent counterflashing. Alternatively, each counterflashing may have a straight section only, and separate corner pieces may be used to overlap adjacent straight sections.

One aspect of the invention relates to a method of sealing an opening of a building by using such an apparatus. The method includes the following steps: securing a perimeter sill about the opening of the building; attaching the cover to the perimeter sill; inserting a counterflashing piece into a channel defined by the sill to engage a retaining mechanism of the sill; and pulling the counterflashing to position the retaining mechanism in the channel to cause the counterflashing to be securely held, the counterflashing having a section to contact a curb of the building.

BRIEF DESCRIPTION OF THE DRAWINGS

Numerous other objects, features, and advantages of the invention should now become apparent upon a reading of the following detailed description taken in conjunction with the accompanying drawing, in which:

FIG. 10 is a perspective view of an alternate embodiment of the present invention, illustrating the placement of preformed corner pieces and corner flashing;

FIG. 11 is a fragmentary cross-sectional view, illustrating the arrangement of the perimeter sill, counterflashing, and skylight taken along line 11—11 of FIG. 10;

FIG. 12 is a cross-sectional view through the perimeter sill illustrating the attachment of the counterflashing, skylight and perimeter sill;

FIG. 13A is a cross sectional view showing the relationship of the rod and the counterflashing when installed; and FIG. 13B is a cross-sectional view further illustrating the relationship between the rod and counterflashing when installed.

DETAILED DESCRIPTION

FIGS. 1–9 show a preferred embodiment of the present invention. An alternative embodiment of the invention is illustrated in FIGS. 10–13.

Figure 1:
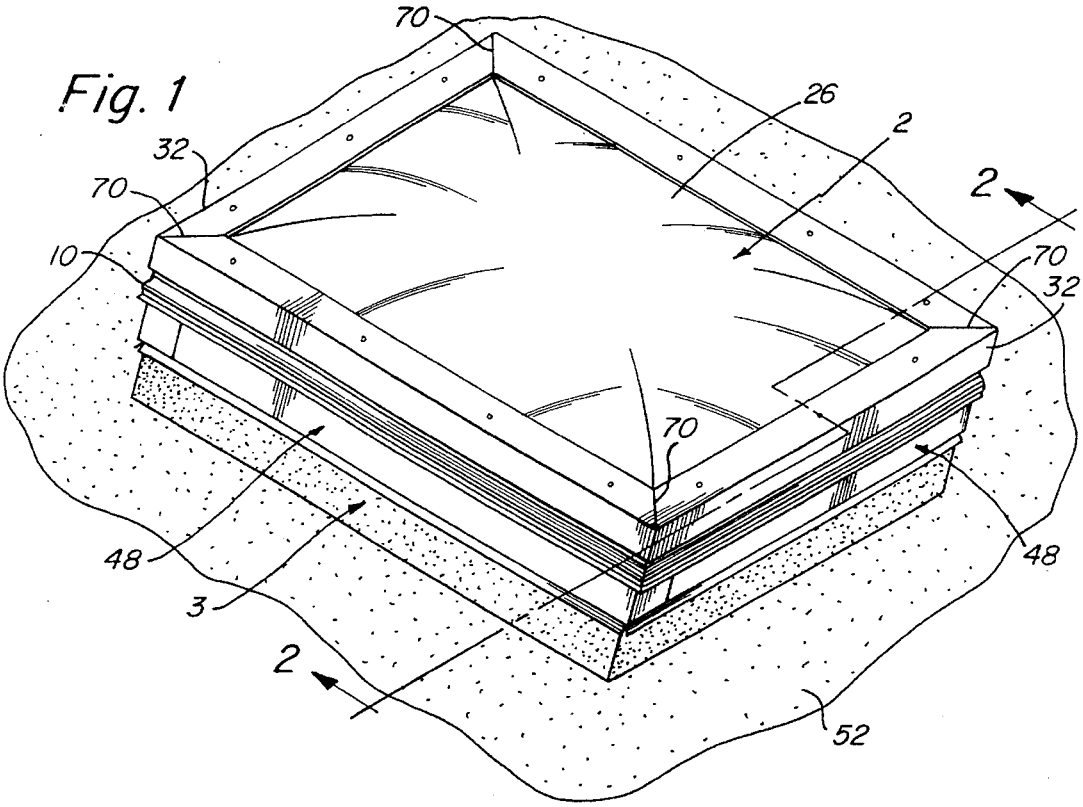
FIG. 1 is a perspective view showing the preferred embodiment of the present invention.

FIG. 1 is a perspective view of a preferred embodiment, illustrating a cover 2 secured over a curb 3 defining a roof opening. The roof and curb are covered with a roof membrane 52 (see also FIG. 2). The cover 2 is a skylight by way of example only.

Figure 2:
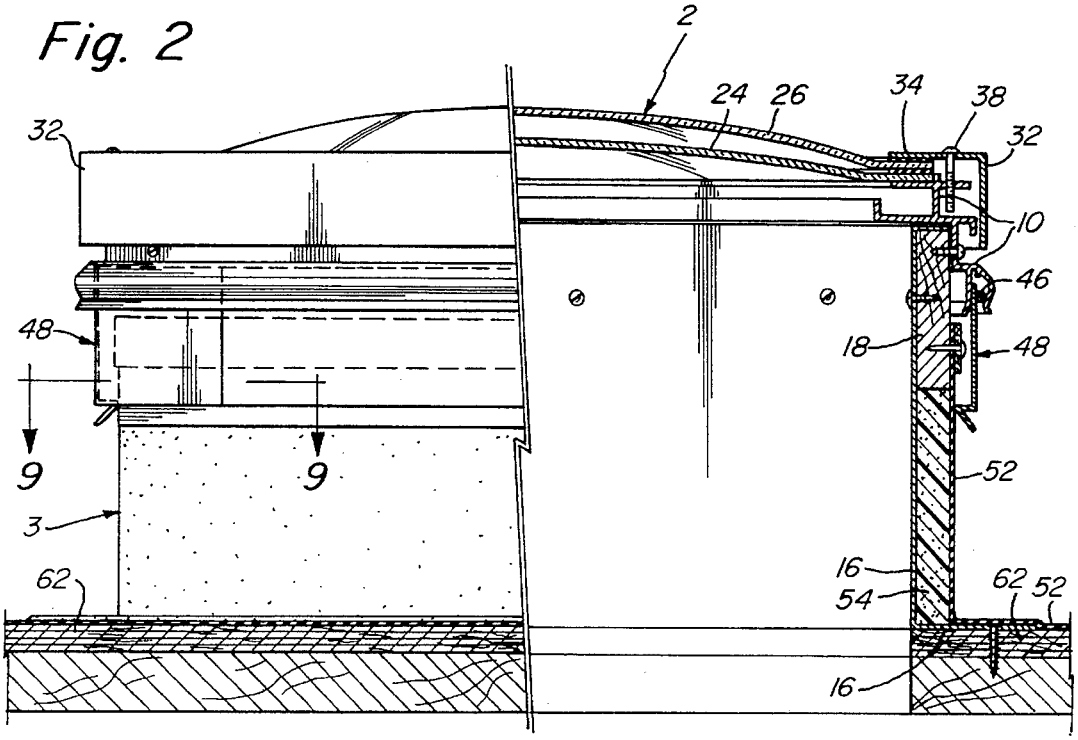
FIG. 2 is a fragmentary cross sectional view illustrating the manner in which the skylight, flashing and roof opening are arranged.

As shown in FIGS. 1 and 2, the cover 2 is sealed relative to the curb 3 with counterflashing pieces 48. The counterflashing 48 is preferably constructed of aluminum, but may be constructed of other materials, as well. The counterflashing 48 provides an easy-to-use and easy-to-install sealing technique and apparatus. The installer needs only one size counterflashing piece, which may be trimmed and formed on site to fit the particular application. The method of installation is simple and relatively inexpensive, requiring relatively few pieces.

Figures 3, 4A, 4B:
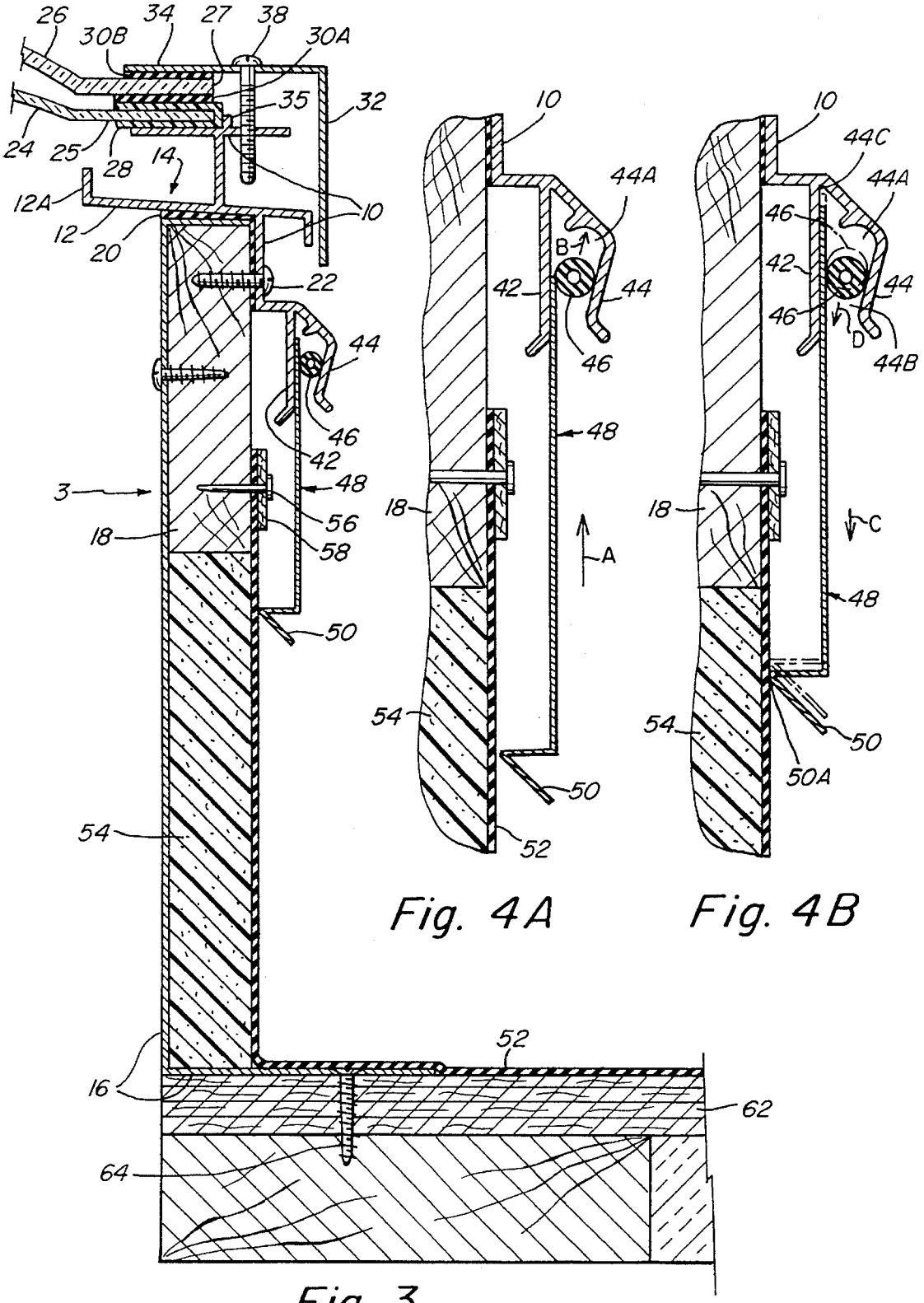
FIG. 3 is a cross sectional view through a perimeter sill of a complete skylight unit, illustrating the counterflashing assembly and rigid perimeter sill.
FIG. 4A is a cross-sectional view through the perimeter sill, showing greater detail of the flashing, rod, and perimeter sill.
FIG. 4B is a cross sectional view through the perimeter sill, showing the interlocking nature of the flashing, rod, and perimeter sill.
Figure 5:
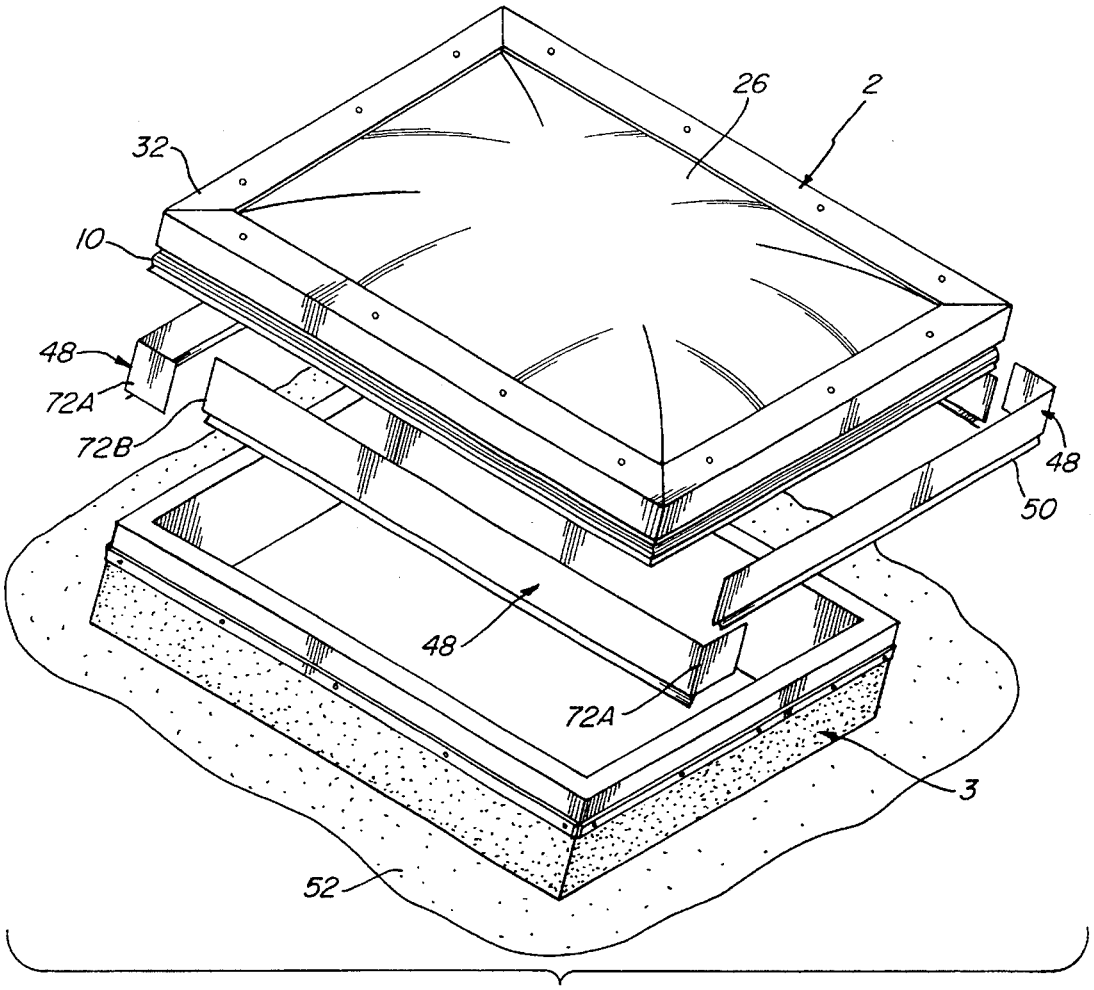
FIG. 5 is a perspective view, showing the installation of the counterflashing.
Figure 6:
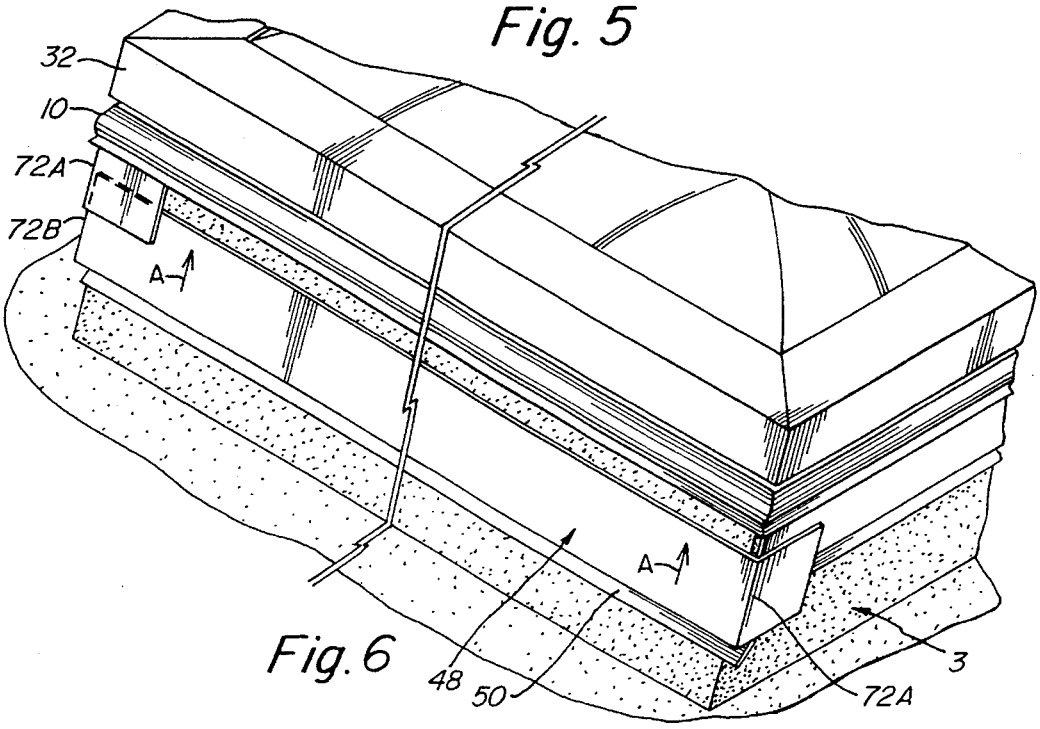
FIG. 6 is a fragmentary perspective view, illustrating the installation of the counterflashing.

As seen in FIGS. 2–4, the membrane 52 may be attached to the curb using a wooden nailer 18 and a reinforcing tack 58 and nail 56. Other adhesive techniques may be used to secure a membrane about the roof and curb.

Referring to FIGS. 2 and 3, the exemplary cover 2 includes an inner dome 24 and an outer dome 26, both of which may be acrylic, for example. The inner dome 24 includes a flange 25 that rests upon a glazing gasket 28. Vertical leg 35 of a sill 10 is used to position the combination of gasket 28 and dome 24. The gasket 28 seals the inner dome 24 in relation to the perimeter sill 10. The outer dome 26 includes a flange 27 that is separated from flange 25 by gaskets 30A and 28. Flange 27 is separated from horizontal leg 34 of frame 32 by gasket 30B. Domes 24 and 26 are held in place by clamping sill 10 and frame 32 together with screws 38. Frame 32 may be made of PVC, aluminum, or the like.

As previously stated, the opening of the building is defined by a curb. The curb 3 may be constructed of plastic foam 54, such as polyisocyanurate, and a frame 16 made of aluminum or other rigid material is used for structural support. The frame 16 may be secured to roof 62 with fasteners 64. Other curb constructions may be used.

Referring to FIGS. 3–4B, a perimeter sill 10 is shown. This sill may be extruded aluminum, for example. The sill 10 includes a condensation gutter 14 formed from a bottom wall 12 and an inner side wall 12*a*. The sill 10 rests on an upper end of curb 3 and is sealed, relative to the curb 3, by a butyl rubber gasket 20. The perimeter sill 10 is secured to the wooden nailer 18 by fasteners 22.

FIG. 4A more particularly shows a portion of the perimeter sill 10, which includes a vertical flashing tab 42 and a flashing clip 44 having a recess 44A. The tab 42 and clip 44 together, define a channel. A retaining mechanism, such as rod 46, is positioned in the channel defined by clip 44 and tab 42. This rod may be made of PVC, for example, and is preferably inserted in the channel during manufacturing. For example, the rod 46 may be inserted longitudinally into the channel. As further discussed below each section of the sill may then be mitred and joined at the mitre joints. One rod 46 runs along each edge of the sill 10 surrounding curb 3.

At installation, the cover, which is attached to the sill as discussed above is placed over the opening. Then, the counterflashing 58 is inserted. A counterflashing is placed flush against a corresponding flashing tab 42. As the counterflashing 48 is inserted, as shown by arrow A, the corresponding retaining rod 46 is caused to move toward recess 44A, as shown by arrow B. Referring to FIG. 4B, the counterflashing 48 is moved upwardly to point 44C and then downwardly, as shown by arrow C. The downward movement causes rod 46 to also move downwardly, as shown by arrow D, due to the forces of gravity and friction. The rod 46 is caused to move from recess 44A towards a narrowed opening 44B of the channel, until the downward pulling causes counterflashing to be securely held. A section of the counterflashing, such as a hooked end 50, is thus caused to contact the exterior surface of curb 30. The dimensions of the hooked end may also ensure a spacing between the counterflashing 48 and the exterior surface. The spacing, in turn, provides an air gap and also allows space for the fastener 56 and clip 58. In addition, the end 50 provides a seal at point 50A. The process is repeated for each counterflashing 48 needed by the application for example, four counterflashing may be needed for a rectangular cover.

Now also referring to FIG. 1, the frame 32 is joined at each miter 70. The perimeter sill and glazing gasket are also preferably formed as an extrusion. As such, the individual parts once mitred may be heat or tig welded to form a rectangular perimeter sill and a rectangular frame 32.

FIGS. 12, 13A, and 13B show another embodiment of the counterflashing. The alternative counterflashing 84 has a retaining hook 86 on its upper edge in addition to a hooked end 88 on its lower edge. The retaining hook 86 is configured such that, when the counterflashing piece 84 is pushed between flashing clip 90 and flashing tab 92, i.e. during installation, the retaining rod 94 is pushed out of the way, as indicated by arrow E, into the retaining rod recess 96. The retaining hook 86 is also shaped such that it catches and downwardly pulls rod 94, when the counterflashing 84 is downwardly pulled, as indicated by arrow C. Pressure from the retaining clip 90 pushing back against the retaining rod 94 prevents the counterflashing hook 86 from being able to slip.

Figure 7:
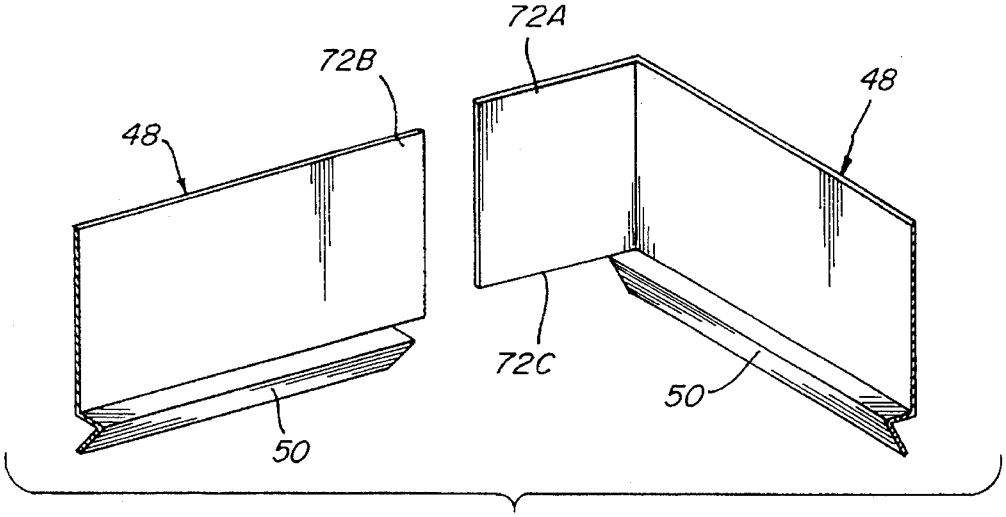
FIG. 7 is an inside exploded perspective view of a counterflashing corner illustrating the overlap of the two ends of the counterflashing at the curb frame corner.
Figure 8:
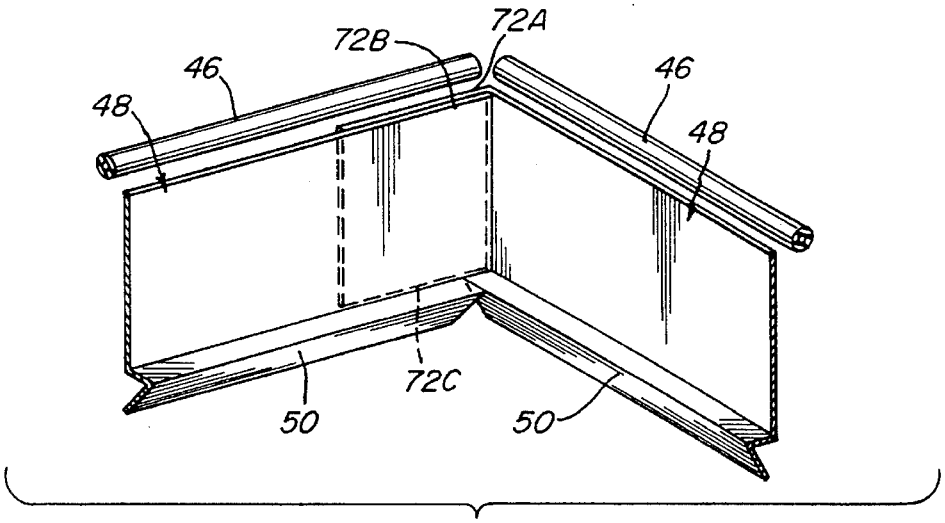
FIG. 8 is an inside perspective view of an assembled counterflashing corner illustrating the rod placement in connection with the counterflashing.
Figure 9:
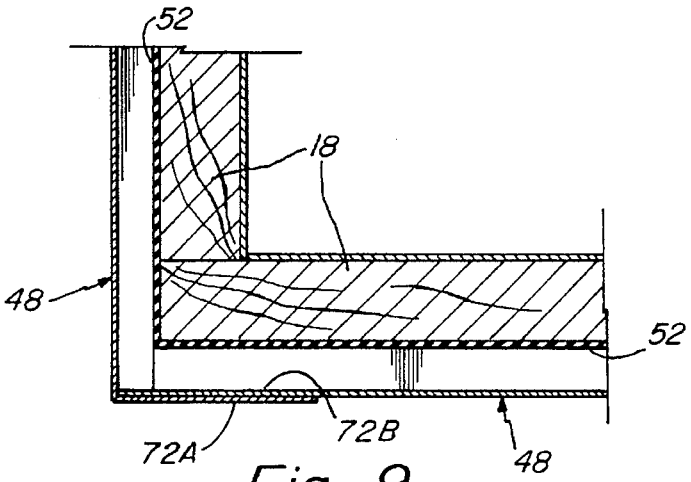
FIG. 9 is a cross-sectional view through the perimeter sill of a completed skylight illustrating the counterflashing corner taken along line 9—9 of FIG. 2.

More than one side of the cover 2 may need to be sealed. As such, the corners of the cover 2 are also desirably sealed. FIGS. 5–9 show a first embodiment of the invention for providing a sealing contact at the corners. Four counterflashing pieces 48 have a angled end 72A and a straight end 72B. The angled end 72A of one counterflashing overlaps with the straight end 72B of an adjacent counterflashing. Preferably, the angled end 72A is exteriorly placed relative to the adjacent straight end 72B. Because the counterflashing 48 is made of materials such as PVC or aluminum, counterflashing 48 may be adjustably flexed to ease installation. As seen in FIGS. 7 and 8, the angled end 72A of the counterflashing 48 does not have a hooked end 50 on its lower edge 72C. This allows for overlapping of the angled end 72A and the straight end 72B without the hooked ends interfering with each other. FIG. 9 illustrates a cross sectional view of a corner, including counterflashing components, along line 9—9 of FIG. 2.

FIGS. 10 and 11 show another embodiment for sealing corners of cover 2. Among other things, these figures show that the invention may be utilized with different roofs an curbs 3 than that previously discussed. For example, FIGS. 10 and 11 show the curb on an inclined roof using shingles 3B, as opposed to rubber membrane 52. In addition, as more particularly shown in FIG. 11, the counterflashing 78 seals against a flashing piece 3*a*, not a membrane 52.

In this embodiment, the counterflashing pieces 78 are straight, not angled at their ends. The lower edge of the straight counterflashing pieces 78 have a hooked end 50 for sealing, similar to that previously described. Four straight counterflashing pieces 78 are used to seal the illustrated cover 2. Likewise, four segments of retaining rod 46 are used, one for each straight counterflashing 78. Unlike the prior embodiment, four corner counterflashing pieces 82 are used, one for each corner of the cover 2.

The corners 82 are inserted after the straight counterflashing pieces 78. Each corner 82 overlaps ends of adjacent straight pieces 78 by a few inches. Unlike the previous embodiment, the corner pieces 82 have a hooked end 50 on both lower edges 82A and 82B for sealing against the flashing piece 3A, or against a rubber membrane, if appropriate. When installed, the hooked end 50 of the corner 82 fits into the side of the hooked end 50 of the straight counterflashing 78.

Having now described certain embodiments of the present invention, it should now be apparent to those skilled in the art that numerous other embodiments and modifications thereof are contemplated as falling within the scope of the present invention as defined by the applied claims.

What is claimed is:

1. A skylight apparatus, comprising:

curb frame defining an opening of a building construction;

translucent cover member for covering the opening;

a retainer for securing the translucent member to the curb frame, the retainer including a sill;

a substantially rigid counterflashing piece for providing weather tightness between the sill and the building construction, said sill having a downwardly-facing channel, having intercoupled first and second sides and a narrowed opening, for receiving the counterflashing piece; and a retaining member, disposed in said channel and engaged between said counterflashing piece and said first side of said channel, said counterflashing piece also being engaged with said second side of said channel so that said counterflashing piece is securely held by a friction force between said counterflashing piece and said second side of said channel.

2. The skylight apparatus as set forth in claim 1 wherein the sill further includes a recess adjacent the downwardly-facing channel, for holding the retaining member when the counterflashing piece is inserted into the downwardly-facing channel.

3. The skylight apparatus as set forth in claim 1 further comprising a corner counterflashing piece for overlapping the counterflashing piece and an adjacent counterflashing piece, the corner counterflashing piece being insertable into the channel.

4. The skylight apparatus as set forth in claim 1 wherein the retaining member is a rod member constructed of rubber-like material.

5. The skylight apparatus as set forth in claim 4 wherein the retaining member is hollow.

6. The skylight apparatus as set forth in claim 1 wherein the counterflashing piece is of generally planar construction having a planar top end that engages in the channel.

7. The skylight apparatus as set forth in claim 6 wherein the top end of the counterflashing piece has a turned end for engaging with the retaining member.

8. The skylight apparatus as set forth in claim 6 wherein the counterflashing piece has a lower turned end adapted to engage against a flashing disposed at the base of the skylight.

9. The skylight apparatus as set forth in claim 1 wherein said sill is constructed of PVC.

10. The skylight apparatus as set forth in claim 1 wherein said sill is constructed of a metal.

11. The skylight apparatus as set forth in claim 1 wherein said sill is aluminum.

12. The skylight apparatus as set forth in claim 1 wherein said translucent cover member includes a plastic dome member.

13. The skylight apparatus as set forth in claim 12 wherein said plastic dome member is constructed of acrylic.

14. The skylight apparatus as set forth in claim 1 wherein said translucent cover member includes a pair of dome members 15. A skylight apparatus as set forth in claim 14 wherein both of the pair of dome members are acrylic.

16. The skylight apparatus as set forth in claim 1, wherein the counterflashing piece includes a straight section and an angled section, the angled section being overlapable with an end of an adjacent counterflashing piece and the angled section being insertable into the downwardly-facing channel.

17. An apparatus for sealing a cover about a building opening, comprising:

a perimeter sill that is attachable to the cover, the sill defining a channel;

a counterflashing piece that is insertable into the channel; and a retaining mechanism having a first position and a second position within the channel, the retaining mechanism being located in the first position when the counterflashing piece is inserted into the channel and located in the second position when the counterflashing piece is pulled in an outward direction from the channel, the retaining mechanism securely holding the counterflashing piece when the retaining mechanism is in the second position.

18. The apparatus of claim 17 wherein the counterflashing piece includes a hooked end to engage the retaining mechanism when the counterflashing is inserted in the channel.

19. The apparatus of claim 17 wherein the perimeter sill includes a flashing clip and a flashing tab defining the channel.

20. The apparatus of claim 19 wherein the flashing clip includes a recess for holding the retaining mechanism when the counterflashing piece is inserted in the channel.

21. The apparatus of 17 wherein the counterflashing piece includes a hooked end to engage against the building, the hooked end being substantially normal to a planar surface of the counterflashing piece.

22. The apparatus of 17 further comprising a corner counterflashing piece for overlapping the counterflashing piece and an adjacent counterflashing piece, the corner counterflashing piece being insertable in the channel.

23. The apparatus of claim 17 wherein the counterflashing piece includes a straight section and an angled section, the angled section overlapable with an end of an adjacent counterflashing piece, and the angled section being insertable in the channel.

24. A method for sealing a cover about a roof opening defined by a curb, the method comprising the steps of:

securing a perimeter sill about the curb, the sill being attached to the cover;

inserting a counterflashing piece into a channel of the perimeter sill to engage a retaining mechanism of the sill for securing the counterflashing in the channel; and pulling the counterflashing to position the retaining mechanism in the channel to cause the counterflashing to be securely held, and counterflashing having a section to contact the curb to form a seal.

25. The method of claim 24 wherein the step of inserting includes inserting the counterflashing piece into the channel so that the retaining mechanism is forced into a recess adjacent the channel.

26. The method of claim 24 wherein the counterflashing has a hooked end, and the step of pulling the counterflashing includes causing the hooked end to position the retaining mechanism and the channel to cause the counterflashing to be securely held.

27. The method of claim 24, further comprising the steps of:

inserting a corner counterflashing piece into the channel of the perimeter sill to engage the retaining mechanism of the sill for securing the counterflashing in the channel; and pulling the corner counterflashing piece to position the retaining mechanism in the channel to cause the counterflashing to be securely held.

28. An apparatus for sealing a cover about a building opening, comprising:

a perimeter sill that is attachable to the cover, the sill defining a downwardly-facing fixed rigid channel formed by a flashing clip and a flashing tab;

a counterflashing piece that is insertable into the fixed rigid channel; and a substantially circular retaining mechanism that is forcibly engaged between a first side and a second side of the fixed rigid channel in order to securely hold the counterflashing piece in place.

29. The apparatus of claim 28 wherein the counterflashing piece includes a hooked end to engage the substantially circular retaining mechanism when the counterflashing is inserted in the fixed rigid channel.

30. The apparatus of claim 28 wherein the flashing clip includes a recess for holding the substantially circular retaining mechanism when the counterflashing piece is inserted in the fixed rigid channel.

31. The apparatus of claim 28 wherein the counterflashing piece includes a hooked end being substantially normal to a planar surface of the counterflashing piece to bias the counterflashing piece against the building to form a seal.

32. The apparatus of claim 28 further comprising a corner counterflashing piece for overlapping the counterflashing piece and an adjacent counterflashing piece, the corner counterflashing piece being insertable in the fixed rigid channel.

33. The apparatus of claim 28 wherein the counterflashing piece includes a straight section and an angled section, the angled section being overlapable with an end of an adjacent counterflashing piece, and the angled section being insertable in the fixed rigid channel.

34. An apparatus for sealing a cover about a building opening, comprising:

a perimeter sill that is attachable to the cover, the sill defining a substantially vertical downward-facing channel;

a counterflashing piece having a first end that is insertable into the channel, and a hooked end that is substantially normal to a planar surface of the counterflashing piece; and a retaining mechanism, disposed within the substantially downward-facing channel, for engaging the first end of the counterflashing piece to securely hold the counterflashing piece in place and to engage the hooked end against the building to form a seal with the building.

35. The apparatus of claim 34, wherein the planer surface of the counterflashing piece is disposed substantially vertically when the counterflashing piece is inserted into the channel.

36. The apparatus of claim 34 wherein the first end of the counterflashing piece includes a hook to engage the retaining mechanism when the counterflashing is inserted in the fixed rigid channel.

37. The apparatus of claim 34 wherein the retaining mechanism is substantially circular.

38. The apparatus of claim 34 wherein the perimeter sill includes a flashing clip and a flashing tab defining the channel.

39. The apparatus of claim 38 wherein the flashing clip includes a recess for holding the retaining mechanism when the counterflashing piece is inserted in the channel.

40. The apparatus of claim 34 further comprising a corner counterflashing piece for overlapping the counterflashing piece and an adjacent counterflashing piece, the corner counterflashing piece being insertable in the channel.

41. The apparatus of claim 34 wherein the counterflashing piece includes a straight section and an angled section, the angled section being overlapable with an end of an adjacent counterflashing piece, and the angled section being insertable in the channel.

* * * * *